US007231691B1

(12) United States Patent
Domenig et al.

(10) Patent No.: US 7,231,691 B1
(45) **Date of Patent: *Jun. 19, 2007**

(54) FULL OVERLAY HINGE WITH THREE-DIMENSIONAL MECHANICAL ADJUSTMENT AND TOP PINS

(75) Inventors: Georg Domenig, Kernersville, NC (US); Jeffery W. Morgan, High Point, NC (US)

(73) Assignee: Grass America Inc., Kernersville, NC (US)

( * ) Notice: Subject to any disclaimer, the term of this patent is extended or adjusted under 35 U.S.C. 154(b) by 202 days.

This patent is subject to a terminal disclaimer.

(21) Appl. No.: 11/065,961

(22) Filed: Feb. 25, 2005

(51) Int. Cl.
*E05D 7/04* (2006.01)

(52) U.S. Cl. ..... 16/236

(58) Field of Classification Search ..... 16/238, 16/235, 236, 240, 242, 243, 245, 246, 382
See application file for complete search history.

(56) References Cited

U.S. PATENT DOCUMENTS

| | | | | |
|---|---|---|---|---|
| 4,716,622 | A | 1/1988 | DeBruyn | |
| 5,295,282 | A | 3/1994 | Lautenschlager | |
| 5,392,493 | A | 2/1995 | Youngdale | |
| 5,511,287 | A | 4/1996 | Lautenschlager et al. | |
| 6,240,599 | B1 | 6/2001 | Peer et al. | |
| 6,643,895 | B1 * | 11/2003 | Domenig et al. | 16/238 |
| 6,647,591 | B1 * | 11/2003 | Domenig et al. | 16/242 |
| 6,694,567 | B1 * | 2/2004 | Domenig et al. | 16/238 |
| 6,845,544 | B2 * | 1/2005 | Hofer | 196/246 |
| 6,880,205 | B2 * | 4/2005 | Rupprechter | 16/235 |
| 6,918,158 | B2 * | 7/2005 | Isele | 16/235 |
| 6,996,877 | B2 * | 2/2006 | Booker et al. | 16/257 |
| 7,017,231 | B2 * | 3/2006 | Isele | 16/242 |
| 7,117,561 | B1 * | 10/2006 | Domenig et al. | 16/236 |

FOREIGN PATENT DOCUMENTS

EP 982455 A2 * 3/2000

* cited by examiner

*Primary Examiner*—Chuck Y. Mah
(74) *Attorney, Agent, or Firm*—John M. Harrington; Kilpatrick Stockton LLP

(57) ABSTRACT

Hinge assembly for mounting a door on a furniture frame for movement of the door between open and closed positions of the door relative to the furniture frame is provided comprising a mounting plate adapted to be affixed to a furniture frame member, an intermediate plate disposed atop of and slideably engaged to said mounting plate, a top plate disposed atop of and slideably engaged to said intermediate plate and said mounting plate, said top plate comprising a body portion having a depending front face and at least one depending rear member, a hinge arm slideably engaged to said top plate, and a guide pin extending through an aperture in the at least one depending rear member under the body portion of the top plate, under a portion of the intermediate plate, and into a corresponding aperture in the front face of the top plate. The hinge assembly is adjustable such that the hinge arm can be adjusted in three dimensions relative to the mounting plate.

8 Claims, 3 Drawing Sheets

FULL OVERLAY HINGE WITH THREE-DIMENSIONAL MECHANICAL ADJUSTMENT AND TOP PINS

FIELD OF THE INVENTION

The present invention relates generally to hinge devices for mounting a door on a furniture article, and more particularly to adjustable hinge devices for hanging doors on cabinets or the like so that the doors can be adjusted relative to the supporting frame they are attached to.

BACKGROUND OF THE INVENTION

Various types of hinges for mounting a door on a furniture article such as a desk or cabinet have been used in the furniture and cabinetry industry for many years. An example of one such device is known from U.S. Pat. No. 4,716,622. Many of such devices include multiple adjustment components making them bulky, difficult to adjust, quick to wear, and unstable. Typically, one or more screws must be loosened, an adjustment made manually, and then one or more screws must be re-tightened to secure the adjustment. Accordingly, many adjustable hinges may require more than one person to accomplish the adjustment. Examples of such hinges include those described in U.S. Pat. Nos. 5,295,282, 5,392,493, and 5,511,287. Improvements to these hinges have been made, such as those depicted in U.S. Pat. No. 6,240,599, so that adjustments can be made quickly and easily by one person. However, further improvements are still needed so that hinges can be adjusted with greater efficiency and more precise reliability. To do this, it has been determined that more refined design engineering is required, and the present invention addresses this need and interest.

Three-dimensionally adjustable hinges of the prior art generally encompass one of two forms. In one such prior art design, the height adjustment of the door is accomplished by loosening the mounting screw or screws which extend into the wood furniture frame, adjusting the hinge vertically, then tightening the wood screws to secure the hinge in position. This is a cumbersome method of adjusting the hinge and often leads to deterioration of the wood and eventual failure of the hinge to support the weight of the door. In another prior art hinge design, a series of adjustment screws are provided; however, they are not capable of independent interaction. The adjustment of one screw necessarily requires adjustment of a second screw. This is due, primarily, to simplify the design of such a hinge. It would therefore be desirable to provide a hinge with three-dimensional mechanical adjustment means which are independent of one another and do not require adjustment of the mounting screw.

The mechanics of adjustable hinge components require various hinge plates to slide upon one another. The hinge components require small tolerances between them so as to minimize play between the components and to securely retain a furniture door in place. Further, the hinge components must support the weight of the door and the stresses associated with opening and closing during operation. As the door moves between an open and a closed position, the forces acting on the various components of the hinge mounting assembly can change dramatically. This has the potential to adversely affect the components and cause excess wear or damage. The additional components required for three dimensional mechanical adjustment must be precisely designed so as to tolerate these stresses, but not interfere with the mechanics of the hinge.

SUMMARY OF THE INVENTION

In a first aspect of the present invention, a hinge assembly for mounting a door on a furniture frame for movement of the door between open and closed positions of the door relative to the furniture frame is provided comprising a mounting plate adapted to be affixed to a furniture frame member, an intermediate plate disposed atop of and slideably engaged to said mounting plate, a top plate disposed atop of and slideably engaged to said intermediate plate and said mounting plate, said top plate comprising a body portion having a depending front face and at least one depending rear member, a hinge arm slideably engaged to said top plate, and a guide pin extending through an aperture in the at least one depending rear member under the body portion of the top plate, under a portion of the intermediate plate, and into a corresponding aperture in the front face of the top plate. The hinge assembly is adjustable such that the hinge arm can be adjusted in three dimensions relative to the mounting plate.

In another embodiment of the present invention, the top plate further comprises a second rear depending member having an aperture therein, and a second guide pin extending through the second depending rear member under the body portion of the top plate, under a portion of the intermediate plate, and into a corresponding second aperture in the front face of the top plate.

In a further embodiment of the present invention, the mounting plate comprises a body portion having an elongated mounting aperture, a front end, a rear end and two side ends, wherein said sides have side members extending upward from said body portion, the side members each comprising an aperture. Further, the intermediate plate further comprises a body portion and two side flanges, each side flange comprising an elongated aperture at least partially aligned with said apertures of the mounting plate, and the hinge assembly further comprises a side guide pin extending from the first aperture of the mounting plate, through the corresponding first elongated aperture of the intermediate plate, across the width of the intermediate plate, through the second elongated aperture of the intermediate plate, then into the second aperture of the mounting plate, such that the intermediate plate is slideably connected to the pin and the mounting plate through the range of motion provided by the elongated apertures.

In a still further embodiment of the present invention, the mounting plate further comprises a leg depending from said front end and said rear end in a direction opposite said side members, said legs positioned and aligned to engage and secure said mounting plate to said furniture frame.

In yet another embodiment of the present invention, the mounting plate comprises two hook members extending upward from the body portion toward the intermediate plate, and said intermediate plate comprises two hook members extending downward toward the mounting plate to engage the hook members of the mounting plate.

In another embodiment of the present invention, the hinge assembly further comprises a hinge cup member pivotably engaged to said hinge arm, and a front cam screw extending through an elongated aperture on said hinge arm, and a circular aperture on the front face of said top plate, such that by rotating the front cam screw, the hinge arm slides up and down on the face of the top plate thereby moving the hinge cup and furniture door from side to side relative to said furniture frame.

In an additional embodiment of the present invention, the hinge assembly further comprising a side cam screw positioned proximate to one side of the top surface of the top plate and extending through an elongated aperture provided in said top surface of the top plate and elongated in a direction parallel to said one side, and through a circular aperture in the intermediate plate, such that by rotating the side cam screw the top plate slides from side to side relative to the intermediate plate and the mounting plate, said pin moving with said top plate, thereby moving said furniture door up and down relative to said furniture frame.

In a further embodiment of the present invention, the hinge assembly further comprising a rear cam screw positioned proximate a rear portion of the hinge assembly and extending through an elongated aperture in said rear portion of the intermediate plate elongated in a direction parallel to said rear portion, and into a circular aperture in a rear portion of said mounting plate, such that by rotating the rear cam screw, the intermediate plate slides front to rear relative to the base plate, said pin and said top plate moving with said intermediate plate, thereby causing the furniture door to move in and out relative to the furniture frame.

It is a feature and advantage of the present invention to provide a hinge with three-dimensional mechanical adjustment means which are independent of one another and do not require adjustment of the mounting screw.

Features of a hinge assembly of the present invention may be accomplished singularly, or in combination, in one or more of the embodiments of the present invention. As will be appreciated by those of ordinary skill in the art, the present invention has wide utility in a number of applications as illustrated by the variety of features and advantages discussed below.

As will be realized by those of skill in the art, many different embodiments of a hinge assembly according to the present invention are possible. Additional uses, objects, advantages, and novel features of the invention are set forth in the detailed description that follows and will become more apparent to those skilled in the art upon examination of the following or by practice of the invention.

Thus, there has been outlined, rather broadly, the more important features of the invention in order that the detailed description that follows may be better understood and in order that the present contribution to the art may be better appreciated. There are, obviously, additional features of the invention that will be described hereinafter and which will form the subject matter of the claims appended hereto. In this respect, before explaining several embodiments of the invention in detail, it is to be understood that the invention is not limited in its application to the details and construction and to the arrangement of the components set forth in the following description or illustrated in the drawings. The invention is capable of other embodiments and of being practiced and carried out in various ways.

It is also to be understood that the phraseology and terminology herein are for the purposes of description and should not be regarded as limiting in any respect. Those skilled in the art will appreciate the concepts upon which this disclosure is based and that it may readily be utilized as the basis for designating other structures, methods and systems for carrying out the several purposes of this development. It is important that the claims be regarded as including such equivalent constructions insofar as they do not depart from the spirit and scope of the present invention.

So that the manner in which the above-recited features, advantages and objects of the invention, as well as others which will become more apparent, are obtained and can be understood in detail, a more particular description of the invention briefly summarized above may be had by reference to the embodiment thereof which is illustrated in the appended drawings, which drawings form a part of the specification and wherein like characters of reference designate like parts throughout the several views. It is to be noted, however, that the appended drawings illustrate only preferred and alternative embodiments of the invention and are, therefore, not to be considered limiting of its scope, as the invention may admit to additional equally effective embodiments.

DETAILED DESCRIPTION

Figure 1:
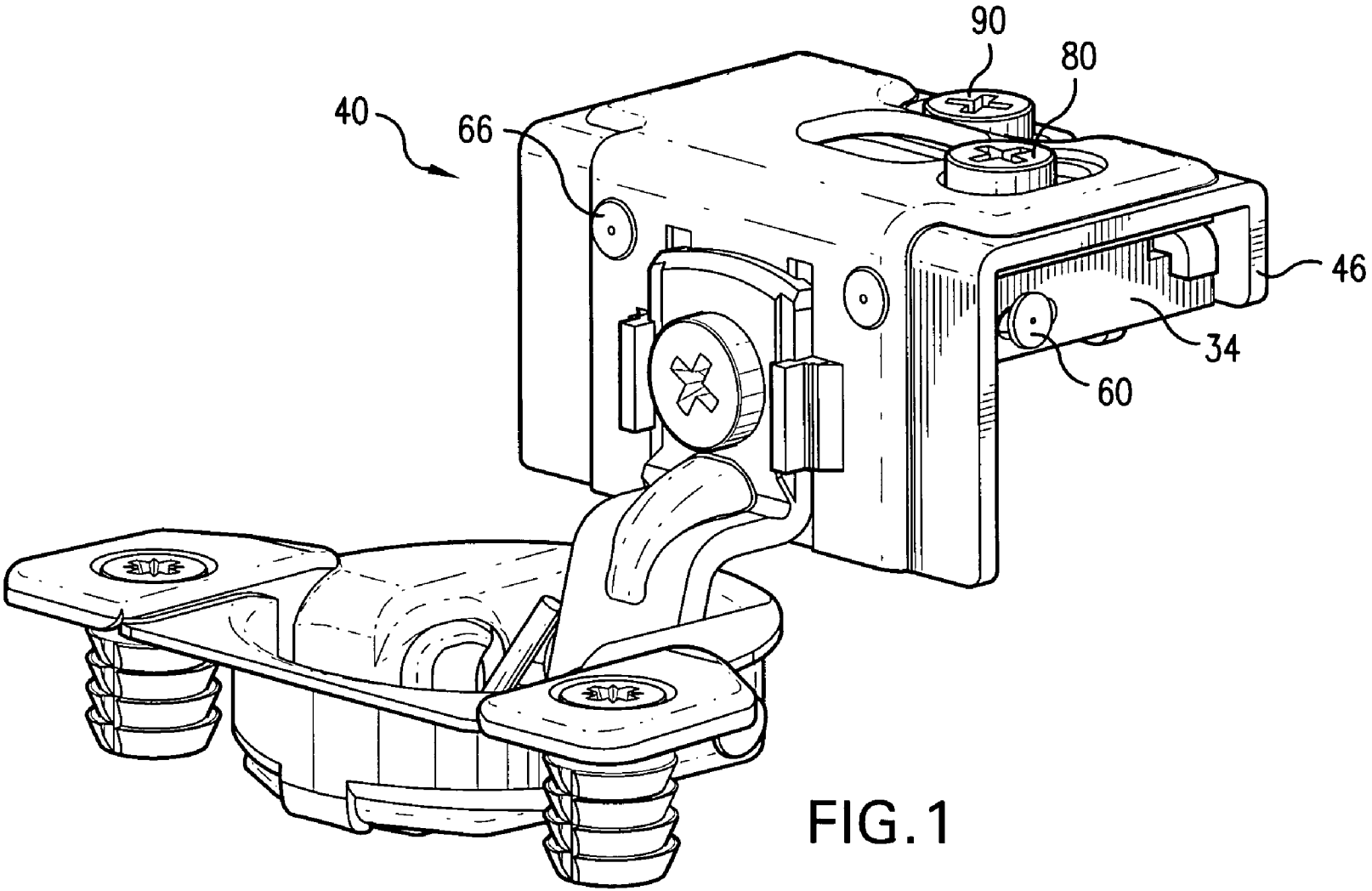
FIG. 1 is a front perspective view of a hinge assembly in an embodiment of the present invention.
Figure 2:
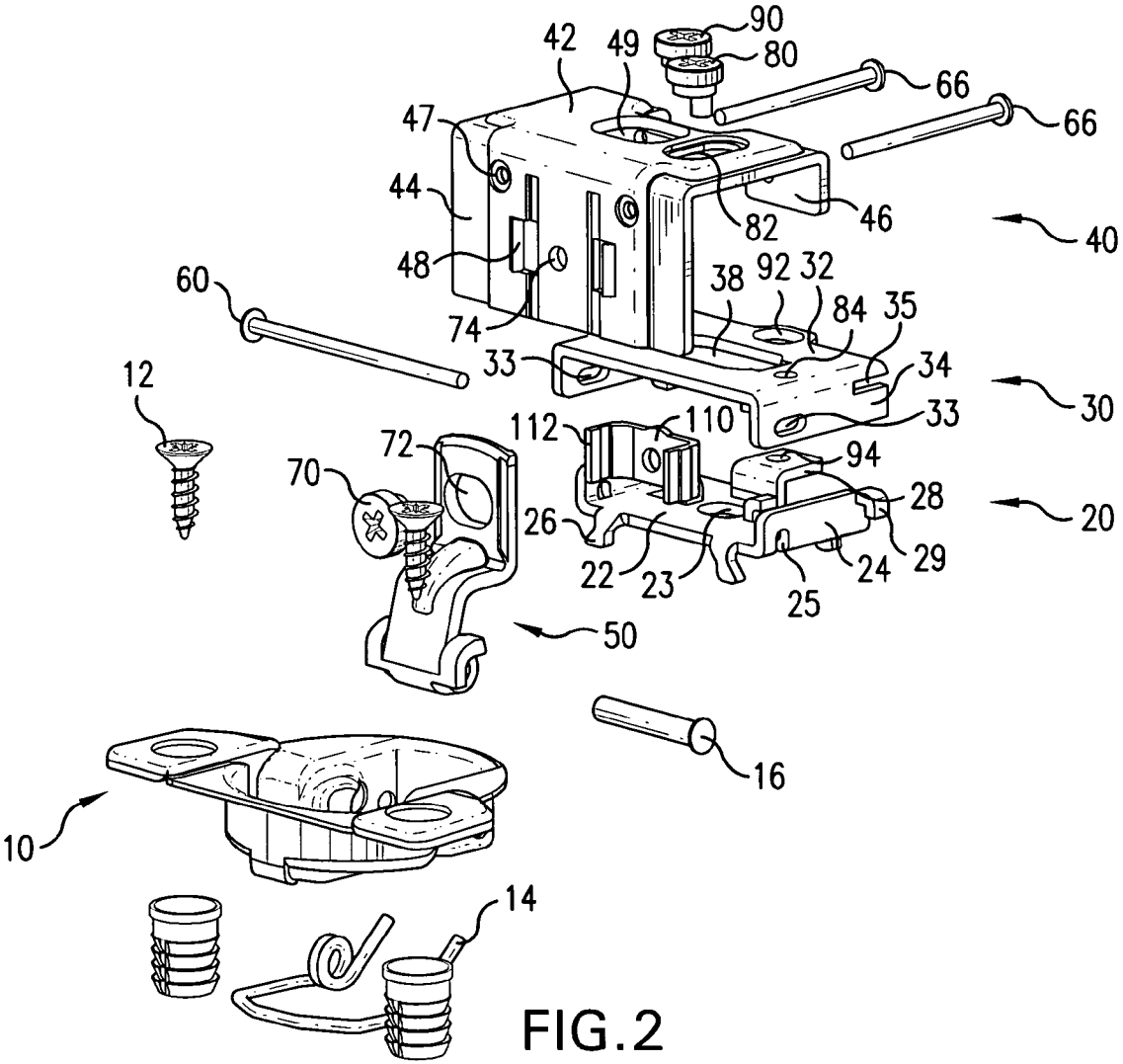
FIG. 2 is a front perspective exploded view of a hinge assembly in an embodiment of the present invention.
Figure 3:
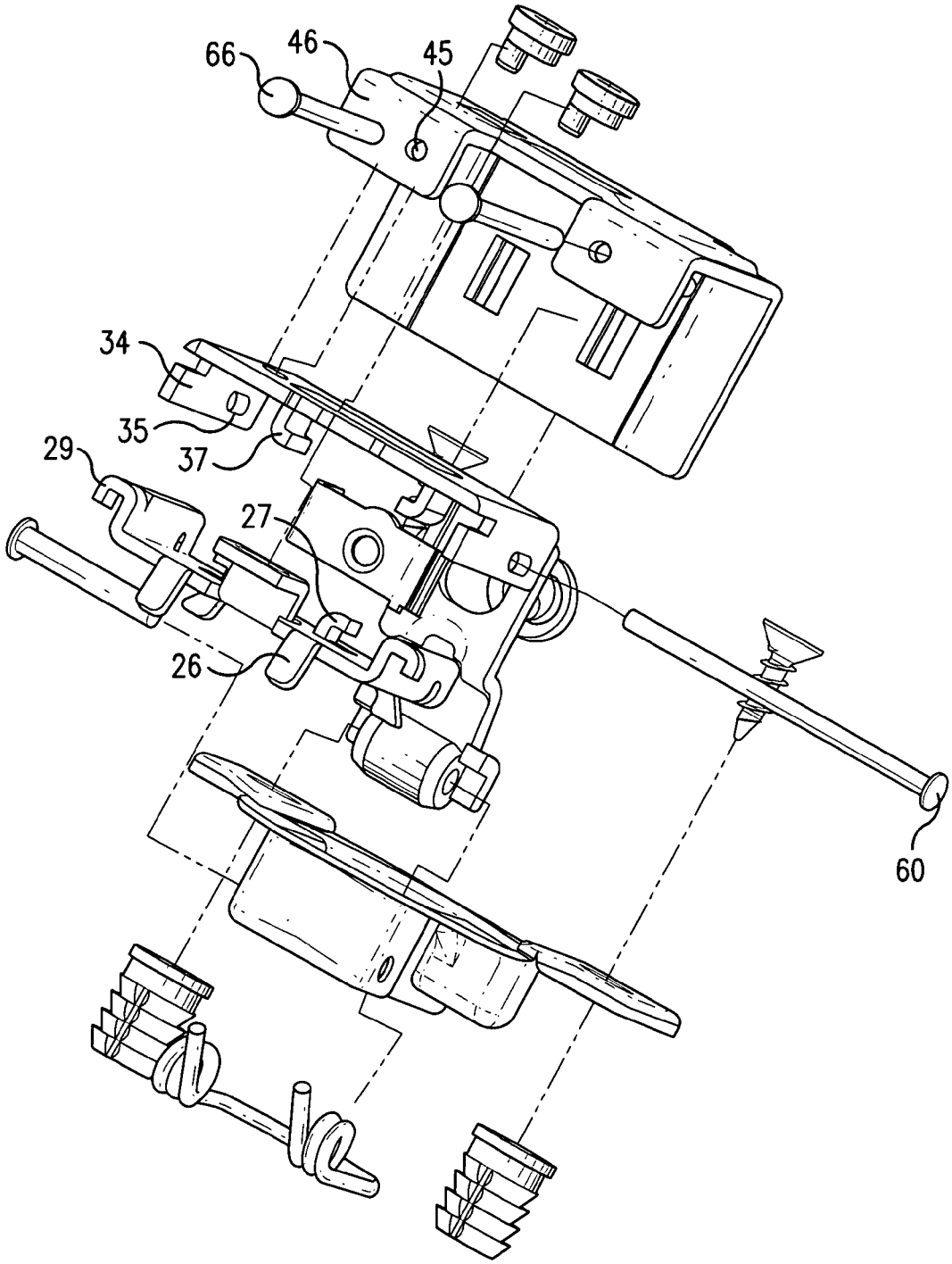
FIG. 3 is a rear perspective exploded view of a hinge assembly in an embodiment of the present invention.

For the purposes of promoting an understanding of the invention, reference will now be made to some preferred embodiments of the present invention as illustrated in FIGS. 1-3, and specific language used to describe the same. Numerous specific details are set forth below in order to provide a thorough understanding of the present invention. However, it will be obvious to one skilled in the art, that the present invention may be practiced without some or all of these specific details. Therefore, it should be understood that no limitation of the scope of the invention is hereby intended. The terminology used herein is for the purpose of description, not limitation. Any modifications or variations in the depicted hinges, and such further applications of the principles of the invention as illustrated herein, as would normally occur to one skilled in the art, are considered to be within the spirit of this invention.

During the description of the many embodiments of the present invention, directional orientation will be used to distinguish among the three degrees of adjustment of the hinge assembly. For the purposes of this discussion, reference will be made to a hinge prior to installation wherein "front" refers to the portion of the hinge assembly closest to the hinge cup, which when installed, will be closest to the furniture door, with "rear" referring to the portion of the hinge assembly farthest from the hinge cup and that which will be facing the rear of the furniture cabinet when installed. The "bottom" of the hinge assembly is that which will be closest to the furniture frame when installed, with "top" being the opposite direction. These parameters are meant to be used for descriptive purposes only and as one skilled in the art will recognize, the hinge assembly may be mounted in an article of furniture in any orientation.

It is a feature and advantage of the present invention to provide a hinge with three-dimensional mechanical adjustment means which are independent of one another and do not require adjustment of the mounting screw. Hinges of the present invention may be used to hang a furniture door to the frame of a furniture article, such as a cabinet. FIG. 1 shows a top perspective view of a hinge assembly in an open position (as it would appear when the cabinet door is open). FIG. 2 shows a front perspective exploded view of a hinge assembly in an embodiment of the present invention so that all the individual parts of hinge assembly can be more readily seen and understood. FIG. 3 shows a rear perspective exploded view of a hinge assembly in an embodiment of the present invention so that all the individual parts of hinge assembly can be more readily seen and understood.

In a first aspect of the present invention, the hinge assembly is based on a five-part hinge assembly comprising a hinge cup 10, pivotably connected to a hinge arm segment 50 which is in turn slideably connected to a top plate 40, which in turn is slideably engaged to an intermediate plate 30, the combination of which is slideably engaged to a mounting plate 20. The mounting plate 20 is secured to a furniture frame member and the hinge cup 10 is secured to a furniture door.

The hinge cup 10 is mountable flush in a bore hole in the back of a door with fastening screws 12 in a known manner, and includes a spring 14 so as to facilitate automatic closing of a door once the hinge has been partially closed. The hinge cup 10 is pivotably connected to the hinge arm 50 with a pin 16 which extends through apertures in the rear of the hinge cup 10 and provides a rotational surface for the end of the hinge arm to engage as is known in the art. Other hinge arm designs may also be used with the present invention, for example the hinge arm 50 may be incorporated into and form a part of the top plate 40, though this limits the adjustability of the hinge arm relative to said top plate.

In a preferred embodiment of the present invention, the distal end of the hinge arm 50 comprises an aperture 72 for receiving a cam screw 70 and abuts a front face of the top plate 40. A circular aperture 74 is provided in the front face 44 of top plate 40 for receiving the off center rod of the cam screw 70. As the screw is rotated, the off center rod spins within the circular aperture 74 causing the top of the cam screw 70 to spin on an eccentric axis within the elongated aperture 72, which in turn causes the hinge arm 50 to move up and down with respect to the top plate 40. In this manner, the hinge arm 50, hinge cup 10, and furniture door may be adjusted in and out relative to the furniture frame.

Mounted to the furniture frame member are the mounting plate 20, intermediate plate 30, and top plate 40. The mounting plate 20 comprises a substantially flat body portion 22 having a front end, a rear end, and two sides. In a preferred embodiment of the present invention, the mounting plate is provided with a mounting aperture 23 for accepting a mounting screw which secures the mounting plate 20 to the furniture frame member. In a most preferred embodiment of the present invention, the mounting aperture 23 is positioned proximate to the center of the body portion 22 and is elongated in a direction parallel to the front and rear ends to allow adjustment of the mounting plate relative to the furniture frame member.

The two sides of the mounting plate 20 are provided with side members 24 extending vertically toward the top of the hinge assembly from the body portion 22. The side members each comprise at least one aperture 25 for receiving a guide pin 60. In a preferred embodiment of the present invention, the apertures 25 are positioned proximate to the front end of the mounting plate.

In a further embodiment of the present invention, the body portion 22 is further provided with a circular aperture 94 for receiving the off center rod of a cam screw. This circular aperture 94 is preferably located toward the rear of the body portion 22 and central to the two side members 24. In another preferred embodiment of the present invention, the rear of the mounting plate comprises a raised rear portion 28 extending upward from the rear of the mounting plate and comprising a horizontal surface including an aperture 94 for receiving the off center rod of a cam screw 90.

In another preferred embodiment of the present invention, the mounting plate further comprises legs 26 depending from the body portion 22 along a front end and a rear end. The legs 26 engage the sides of the furniture frame member and assist in retaining the hinge assembly in position with respect to the frame member. In an alternate embodiment of the present invention, one leg 26 is provided extending across substantially each of the front and the rear of the body portion 22 of the mounting plate 20.

The intermediate plate 30 is slideably engaged to the mounting plate 20 such that it is free to move front to rear relative to the fixed mounting plate 20. The intermediate plate 30 comprises a substantially flat body portion 32 having two side flanges 34 on either side thereof and a front end and a rear end. A central aperture 38 is preferably provided to allow access, through the intermediate plate 30, to the mounting screw engaging the mounting plate 20. In a preferred embodiment of the present invention, the side flanges 34 extend vertically downward from the body portion 32, toward the mounting plate 20. Apertures 35 are provided on the flange 34 and are aligned with the apertures 25 in the mounting plate 20 for receiving the guide pin 60. In a preferred embodiment of the present invention, the apertures 35 in the intermediate plate are elongated to provide a slideable range of motion for the pin 60.

In a preferred embodiment of the present invention, the side flanges 34 of the intermediate plate 30 are preferably spaced farther from one another than the side members 24 of the mounting plate 20. In this manner, the intermediate plate 30 and flanges 34 fit over and encompass the side members 24 of the mounting plate.

When engaged to the mounting plate 20 with the guide pin 60, the intermediate plate 30 is free to slide from front to rear relative to the mounting plate 20 by sliding through the range of motion provided by the elongated apertures 35 in the side flanges 34 of the intermediate plate 30.

In a preferred embodiment of the present invention, this slideable connection is facilitated by providing the mounting plate 20 with hook members 27 which extend upward from the body portion 22. Counterpart hook members 37 are provided extending downward from the intermediate plate 30 to engage the hook members 27 of the mounting plate 20. In another preferred embodiment of the present invention, the hook members 27, 27 are positioned on either side of the central apertures 23, 38 in the mounting plate 20 and intermediate plate 30, respectively. The interaction of the hook members 27, 37 provide additional support to the plates 20, 30 and keep them securely engaged.

In an alternate embodiment of the present invention, the configuration of the apertures for receiving the side guide pin 60 on the mounting plate 20 and intermediate plate 30 are reversed. In this embodiment, the apertures 25 on the side member 24 of the mounting plate 20 are elongated, and similarly, the apertures 35 on the side flanges 34 of the intermediate plate 30 are circular. This configuration, though opposite of that found in the preferred embodiment, will still provide a slideable connection between the mounting plate 20 and the intermediate plate 30 to allow the intermediate plate 30 to slide from front to rear relative to the mounting plate 20.

In another preferred embodiment of the present invention, another means for providing a secure engagement between the mounting plate 20 and intermediate plate 30 is provided in the rear portion of the plates 20, 30. The mounting plate 20 is provided with side hook members 29 positioned proximate to the rear of the side members 24. The hooks 29 extend outward from the side members 24 then downward to form a hook. The intermediate plate 30 has corresponding slots 33 in the rear portion of the flanges 34 for accepting and slideably engaging the hook members 29. This configuration allows the intermediate plate 30 to slide from front to rear relative to the mounting plate 20, but prevents movement of the intermediate plate 30 upwards and away from the mounting plate 20. These retention means in connection with the central hook members 27, 37 on the two plates 20, 30 provide a strong slideable connection between the mounting plate 20 and the intermediate plate 30. This strong slideable connection allows the hinge assembly to be adjustable while retaining sufficient strength to support the weight of a cabinet door.

The top plate 40 is positioned over and encompasses the intermediate plate 30 and mounting plate 20. The top plate 40 comprises a body portion 42 having a front end, a rear end, and two sides. The body portion 42 further comprises a central aperture 49 aligned with the central aperture 38 of the intermediate plate 30 to allow access to the mounting screw engaged to the mounting plate 20. The body portion 42 is further provided with an elongated aperture 82 for receiving a cam screw 80 positioned off center proximate to one side of the body portion 42.

Depending from the front end of the body portion 42 is a front face 44 which extends downward to cover the intermediate plate 30 and mounting plate 20 and further provide a surface for slideably engaging the hinge arm 50. The front face 44 is further provided with a circular aperture 74 for receiving the cam screw 70. In a preferred embodiment of the present invention, the circular aperture 74 is flanked by two slots 48. The slots receive the legs 112 of a clip 110 which is employed to slideably retain the hinge arm 50. The clip 110 is positioned through the rear of the front face 44 and the legs 112 protrude through the slots 48 and engage the hinge arm 50. The legs 112 are designed with slight hooks on their distal end to grasp and engage the hinge arm 50. The hinge arm is then slideably engaged to the front face 44 as is know in the art.

To illustrate the position of the various plates and pins in the assembled hinge assembly, FIGS. 2 and three 3 show exploded front and rear views of a preferred embodiment of the present invention, respectively. The side pin 60 extends through a first elongated aperture in one side of the intermediate plate 30, then through a first circular aperture 25 in one side 24 of the mounting plate 20. The pin continues across the interior body of the hinge assembly, extending through the corresponding second round aperture 25 in the side member 24 of the mounting plate 20, and finally the elongated aperture 35 in the side flange 34 of the intermediate plate 30.

The top guide pins 66 extend through the apertures 45 in the rear members 46 of the top plate 40, underneath the body portion 32 of the intermediate plate 30, preferably between the hook members 37 and the side flanges 34 of the intermediate plate, then through the corresponding apertures 47 in the front face 44 of the top plate 40. In this manner, the intermediate plate 30 is securely, but slideably, engaged to the top plate 40.

This configuration connects and engages the three plates such that they are slideable and adjustable relative to one another. The adjusting of the plates is accomplished through the cam screws 80 and 90. The side cam screw 80 extends through the elongated aperture 82 in the body portion 42 of the top plate 40. The elongated aperture is preferably located proximate to one side of the body portion and elongated in a direction parallel to the side. The off center rod of the cam screw 80 extends through the elongated aperture 82 and engages a circular aperture 84 provided in the body portion 32 of the intermediate plate 30. The off center rod rotates within the circular aperture 84 causing the top of the cam screw to spin on an eccentric axis within the elongated aperture 82 which in turn causes the top plate 40 to move side to side relative to the intermediate plate 30.

Throughout this motion, the intermediate plate 30 remains stationary and engaged to the mounting plate 20. As the top plate moves from side to side, the hinge arm 50, hinge cup 10 and furniture door are adjusted up and down relative to the furniture frame member. In this manner the position of the furniture door relative to the floor and furniture frame member may be adjusted by rotating the side cam screw 80. In a preferred embodiment of the present invention, the top guide pins 66 will move along with the top plate 40 through the motion of the adjustment. The guide pins 66 will in turn slide from side to side along the underside of the body portion 32 of the intermediate plate 30.

The rear cam screw 90 extends through the elongated aperture 92 in the body portion 32 of the intermediate plate 30. The elongated aperture 92 is preferably located proximate to the rear of the body portion 32 and elongated in a direction parallel to the rear end. The off center rod of the cam screw 90 extends through the elongated aperture 92 and engages a circular aperture 94 provided toward the rear of the body portion 22 of the mounting plate 20. In a preferred embodiment of the present invention, the circular aperture 94 in the body portion 22 of the mounting plate 20 is disposed upon a raise portion 28 extending form the rear of said mounting plate 20. The off center rod rotates within the circular aperture 94 causing the top of the cam screw to spin on an eccentric axis within the elongated aperture 92 which in turn causes the intermediate plate 30 to move from front to rear relative to the mounting plate 20.

Throughout this motion, the top plate 40 remains stationary relative to the intermediate plate 30 and moves with the intermediate plate 30 relative to the mounting plate 20. The side guide pin 60 extending through the intermediate plate 30 and mounting plate 20 remains stationary while the intermediate plate 30 slides along the pin 60 throughout the degree of motion provided by the elongated apertures 35 in the side portion 34 of the intermediate plate 30.

Although the present invention has been described with reference to particular embodiments, it should be recognized that these embodiments are merely illustrative of the principles of the present invention. Those of ordinary skill in the art will appreciate that the apparatus and methods of the present invention may be constructed and implemented in other ways and embodiments. Accordingly, the description herein should not be read as limiting the present invention, as other embodiments also fall within the scope of the present invention.

What is claimed is:

1. A hinge assembly for mounting a door on a furniture frame for movement of the door between open and closed positions of the door relative to the furniture frame, the assembly comprising:

a mounting plate adapted to be affixed to a furniture frame member;

an intermediate plate disposed atop of and slideably engaged to said mounting plate;

a top plate disposed atop of and slideably engaged to said intermediate plate and said mounting plate, said top plate comprising a body portion having a depending front face and at least one depending rear member;

a hinge arm slideably engaged to said top plate;

a first guide pin extending through an aperture in the at least one depending rear member under the body portion of the top plate, under a portion of the intermediate plate, and into a corresponding aperture in the front face of the top plate;

wherein said top plate further comprises a second rear depending member having an aperture therein, and a second guide pin extending through the second depending rear member under the body portion of the top plate, under a portion of the intermediate plate, and into a corresponding second aperture in the front face of the top plate;

said intermediate plate is slideable relative to the mounting plate in a direction parallel to a longitudinal axis of the first and second pins, and said top plate is slideable relative to the intermediate plate in a direction perpendicular to the longitudinal axis of the first and second pins; and wherein said hinge assembly is adjustable such that the hinge arm can be adjusted in three dimensions relative to the mounting plate.

2. The hinge assembly of claim 1, wherein said mounting plate comprises a body portion having an elongated mounting aperture, a front end, a rear end and two side ends, wherein said sides have side members extending upward from said body portion, the side members each comprising an aperture;

wherein said intermediate plate further comprises a body portion and two side flanges, each side flange comprising an elongated aperture at least partially aligned with said apertures of the mounting plate side members; and, wherein said hinge assembly further comprises a side guide pin extending from a first of said apertures of the mounting plate side members, through a corresponding first of said elongated apertures of the intermediate plate, across the width of the intermediate plate, through a second of said elongated apertures of the intermediate plate, then into a second of said apertures of the mounting plate side members, such that the intermediate plate is slideably connected to the pin and the mounting plate through the range of motion provided by the elongated apertures of the intermediate plate.

3. The hinge assembly of claim 2, wherein said mounting plate further comprises a leg depending from said front end and said rear end in a direction opposite said side members, said legs positioned and aligned to engage and secure said mounting plate to said furniture frame.

4. The hinge assembly of claim 2, wherein said mounting plate comprises two hook members extending upward from the body portion toward the intermediate plate, and said intermediate plate comprises two hook members extending downward toward the mounting plate to engage the hook members of the mounting plate.

5. The hinge assembly of claim 1, further comprising a hinge cup member pivotably engaged to said hinge arm.

6. The hinge assembly of claim 5, further comprising a front cam screw extending through an elongated aperture on said hinge arm, and a circular aperture on the front face of said top plate, such that by rotating the front cam screw, the hinge arm slides up and down on the depending front face of the top plate thereby moving the hinge cup and furniture door from side to side relative to said furniture frame.

7. The hinge assembly of claim 1, further comprising a side cam screw positioned proximate to one side of the top surface of the top plate and extending through an elongated aperture provided in said top surface of the top plate and elongated in a direction parallel to said one side, and through a circular aperture in the intermediate plate, such that by rotating the side cam screw the top plate slides from side to side relative to the intermediate plate and the mounting plate in said direction perpendicular to the longitudinal axis of the first and second pins, said pins moving with said top plate, thereby moving said furniture door up and down relative to said furniture frame.

8. The hinge assembly of claim 1, further comprising a rear cam screw positioned proximate a rear portion of the hinge assembly and extending through an elongated aperture in said rear portion of the intermediate plate elongated in a direction parallel to said rear portion, and into a circular aperture in a rear portion of said mounting plate, such that by rotating the rear cam screw, the intermediate plate slides front to rear in said direction parallel to the longitudinal axis of the first and second pins relative to the mounting plate, said pins and said top plate moving with said intermediate plate, thereby causing the furniture door to move in and out relative to the furniture frame.

* * * * *